United States Patent [19]

Gueret

[11] Patent Number: 4,929,108

[45] Date of Patent: May 29, 1990

[54] APPLICATOR VENTING ARRANGEMENT

[75] Inventor: Jean-Louis Gueret, Paris, France

[73] Assignee: L'Oreal, Paris, France

[21] Appl. No.: 367,724

[22] Filed: Jun. 19, 1989

[30] Foreign Application Priority Data

Jun. 27, 1988 [FR] France ..... 88 08591

[51] Int. Cl.[5] ..... A45D 33/02; A45D 40/00

[52] U.S. Cl. ..... 401/126; 401/122; 401/123; 401/130

[58] Field of Search ..... 401/122, 126, 130, 123; 132/299

[56] References Cited

U.S. PATENT DOCUMENTS

Re. 21,757 4/1941 Deakers et al. .
3,694,096 9/1972 Seidler .
4,780,017 10/1988 Bradford ..... 401/126 X

FOREIGN PATENT DOCUMENTS 2558833 7/1976 Fed. Rep. of Germany .
2071574 9/1971 France .

*Primary Examiner*—Steven A. Bratlie
*Attorney, Agent, or Firm*—Cushman, Darby & Cushman

[57] ABSTRACT

The applicator set (101) includes a bottle (102), provided with a neck (103) and intended to contain a product (P), a cap (104) for closing the bottle, and an applicator (106) disposed at the end of a rod (107) attached to the cap (104). The bottle (102) includes means (C) for compacting the product around the applicator (106), upon which means the user can act, and elastic means (R) for returning the compacting means (C) to the position of repose. The applicator (106) is made of a porous material, and the air present in the bottle (102), which is compressed at the time of compacting, can escape via the cap (104), passing through the hollow rod of the applicator (107), after having passed through the porous material of the applicator (106).

15 Claims, 2 Drawing Sheets

APPLICATOR VENTING ARRANGEMENT

FIELD OF THE INVENTION

The present invention relates to an applicator set for a powdered or paste product, in particular a cosmetic product, of the type including a container or bottle provided with a neck and intended to contain the product, a cap to close the container, and an applicator disposed at the end of a rod attached to the cap. The invention relates more particularly, but not exclusively, to a set for applying mascara or eyeshadow.

BACKGROUND OF THE INVENTION

When the container of such a set contains a powder, such as a powder used in makeup, without an oily binder, it is generally possible to obtain good distribution of the powder without difficulty on the applicator mounted at the end of the rod; this applicator then makes it possible to apply the powder relatively satisfactorily. Nevertheless, such a powder does not adhere well to the surface, such as a eyelid, because the surface is too "dry".

Hence it is preferable to use a powder including an oily binder, which better assures the adherence of the powder to the surface to which it is applied.

Nevertheless, even though such a powder may be slightly oily, if it is in the form of loose powder it is more difficult to distribute with an applicator set of the type described above, in which the applicator disposed on the end of the rod in general has a tapered shape, such as a frustoconical shape. Such a powder including a binder, which will be called "oily loose powder" herein, tends to form clumps, which makes it difficult if not impossible to saturate the applicator. Moreover, the oily loose powder itself spreads poorly over the applicator.

In French Patent Application 87 12073, filed on Aug. 31, 1987, an applicator set of the above type has been proposed in which the bottle has means, at its end opposite that provided with a cap and the applicator, on which the user can act in order to compact the product around the applicator, and elastic means for returning the compacting means to the position of repose when the user ceases such action. Preferably, the compacting means include a piston mounted to slide in the bottle and connected to a pushbutton that projects beyond the end of the bottle opposite the cap.

Nevertheless, when one presses on the pushbutton to compact the product around the applicator, the air contained in the reservoir is compressed. Under these conditions, a "piston effect" takes place inside the container, and consequently the compacted product does not cling in a favorable manner to the applicator.

OBJECT AND SUMMARY OF THE INVENTION

The present invention makes it possible to overcome this disadvantage, and to this end proposes allowing the air to escape to the outside at the moment of compacting, via the applicator carrier tube; the applicator itself is made of a porous and spongy material, such as an open-cell foam, in such a way that the compressed air can pass through it before being evacuated. Additionally, the present invention makes it possible to apply a cream as well, and the compacting and passage of air through the applicator permits better filling and saturation of the applicator.

Hence the subject of the present invention is the novel industrial product comprises an applicator set for a powdered or paste product, in particular a cosmetic product, including a container provided with a neck and intended to contain the product, a cap for closing the container, and an applicator disposed at the end of a rod attached to the cap. The container includes means for compacting the product around the applicator means on which the user can act to generate a compacting of the product, and elastic means to return the compacting means to their position of repose when the user ceases the compacting action; in accordance with the invention, the applicator is made of a material permeable to air, and the rod of the applicator includes at least one passage for evacuation of the air which is present in the container and which is compressed at the time of compacting; the air to be evacuated penetrates the rod after passing through the material permeable to the air of which the applicator is made, and escapes via the evacuation passage or passages to outside the cap.

In accordance with a preferred embodiment of the applicator set according to the invention, the material of the applicator is a porous and spongy material. The rod advantageously comprises a hollow element defining an axial conduit for passage of the air to be evacuated, and the rod includes a terminal portion that supports the applicator; there are lateral air passage conduits in the terminal portion that discharge into the axial conduit.

In accordance with another feature of the present invention, at the opposite end of the applicator the rod terminates in a tip assuring the solid attachment of the rod and cap; the air evacuation passage or passages communicate with the outside via at least one conduit made between the cap and the rod. In particular, this tip may be introduced with force into the cap; the lateral walls facing the tip and the cap include radial fins, between which the air evacuation conduits are made, and the free end of the tip is spaced apart from the base of the cap. Moreover, the fins carried by the cap assure the interlocking of the cap onto the end of the neck of the container when the set is in the closing position.

In the case where the compacting means include a piston mounted to slide in the container, this piston being connected to an external pushbutton, it may be advantageously provided that the neck comprises a tubular element mounted to slide in an opening made in the upper wall of the container, and at its end adjacent to the container it has an external collar comprising the piston and returned to inside the aforementioned wall of the bottle by the action of the elastic return means. The means for controlling the piston comprise the cap, put in place on the container in its position of closure of the container, the distance between the free edge of the cap and the upper wall of the container in the aforementioned position of closure being equal at least to the maximum travel of the piston. The elastic return means may include a helical spring disposed between the piston and the base of the container or an element carried by the base of the container.

The piston advantageously comprises a squeegee holder, and to this end includes a lip for squeegeeing the applicator. The container may comprise a tubular body bent at one of its ends to comprise the upper wall of the bottle traversed by the neck, the body being closed at its other end with a removable stopper.

It may also be provided that the compacting means comprise a piston connected to an external pushbutton which projects beyond the end of the container opposite the neck. Preferably, the piston is then provided with a central hole making it possible to fill the applicator and with a stopper device to close this central hole after filling of the applicator. Preferably, the elastic return means comprise a helical spring disposed between the piston and an element that partially surrounds the applicator. The element surrounding the applicator is preferably attached to a part that forms a neck having a thread, mounted with force in the container.

When the product to be applied is a powder, the powder includes microcapsules including liquid substances such as oils, binders or active ingredients, such as moisturizing agents, or substances for hypoallergenic, anti-wrinkle or dermatological treatment; these microcapsules release their contents in the vicinity of the applicator at the time of the compacting phase.

For better comprehension of the subject of the present invention, two exemplary embodiments will be described in detail below, referring to the accompanying drawings.

DESCRIPTION OF THE PREFERRED EMBODIMENTS

Figure 1:
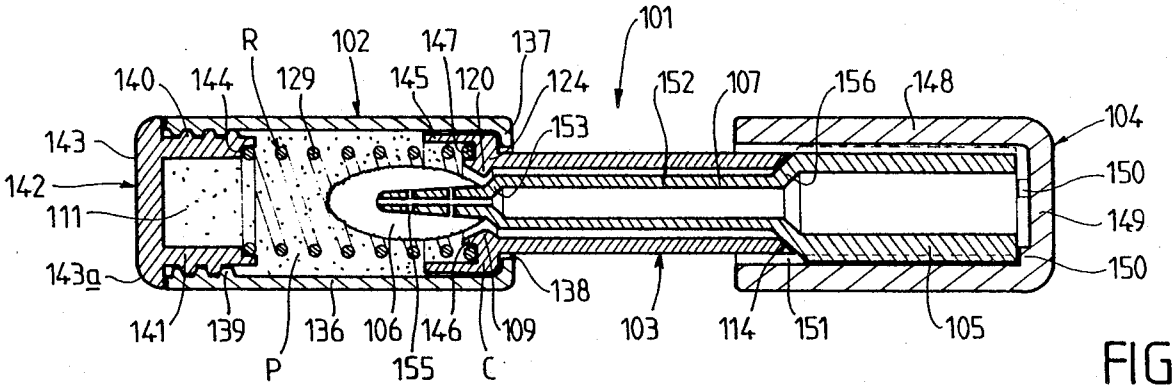
FIGS. 1 and 2 are axial sections of the same applicator set according to the invention, with the cap in place on the container and the powder in the loose state in FIG. 1 and in the state in which it has been compacted about the applicator in FIG. 2.
Figure 2:
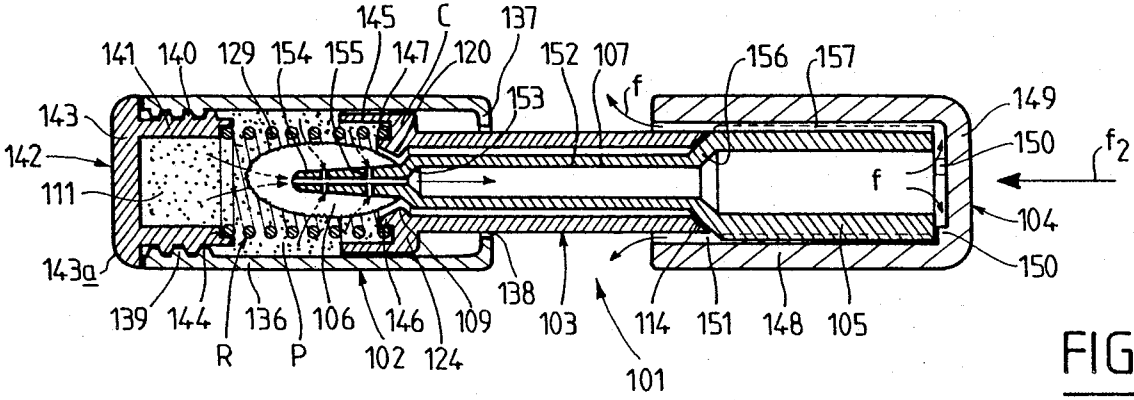

Turning first to FIGS. 1 and 2, an applicator set 101 is shown for a powdered product P, in particular a cosmetic product, such as a mascara mixed with the oily binder and comprising an oily loose powder. The container of the applicator set 101 is a bottle 102 intended to contain the product P. The bottle 102 has the general shape of a cylinder of revolution; it is provided with a neck 103 arranged to slide axially in the bottle 102 as will be described hereinafter.

A removable cap 104 is intended to close the bottle 102 being adapted to the free end of the neck 103. The cap 104 comprises a brush making it possible to manipulate an applicator 106 carried by the end of a rod 107 attached to the cap 104 at its tip 105 opposite the applicator 106. The applicator 106 penetrates to the interior of the bottle 102 via an orifice 109 bounded by a squeegee lip 120, the function of which is to exert a squeegee action on the applicator 106, to eliminate excess makeup product picked up by the applicator 106 inside the bottle 102.

The bottle 102 includes a cylindrical body 136, which is bent at a right angle toward the inside at one of its ends, to make annular wall 137 the inner edge of which defines a circular opening 138. In the vicinity of the end opposite the wall 137, the body 136 has a thread 139 on its inside, intended to cooperate with the external thread 140 of the cylindrical flange 141 of a removable stopper 142 intended to plug the body 134 at that end. The stopper 142 includes a flat bottom 143, having a diameter corresponding to the outside diameter of the body 136, and the aforementioned flange 141 is connected to this flat bottom. The outer edge 143a of the bottom 143 is rounded. In the vicinity of its free edge, the flange 141 includes a recess on the inside of its inner wall, forming an annular bearing 144 on which the end of a helical spring 129 is supported; this spring comprises the elastic return means R for the means for compacting the powder P about the applicator 106, as will be described hereinafter.

When the stopper 142 is screwed onto the body 136, a reservoir 111 is formed in the body 136, intended to contain the product P.

The neck 103 comprises a very elongated cylindrical tubular element, the outside diameter of which is slightly less than the diameter of the circular opening 138. On its free end, the inner edge of the neck 103 is beveled, as a result of which the applicator 106 is easy to introduce into the bottle 102 because of the frustoconical flaring out of the opening 114 thus effected.

At the opposite end, the neck 103 is folded at a right angle toward the outside along an annular collar 124, which forms a piston comprising the compacting means C.

The element 124, which is intended to be placed inside the bottle 102 by being pressed by the spring 129 against the annular wall 137, has a total diameter substantially equal to or very slightly less than the inside diameter of the body 136; it has a cylindrical flange 145 that is coaxial with the neck 103, and opposite the neck this flange has the same outside diameter as the element 124.

On its entire inside edge, the element 124 also includes a bead oriented toward the inside and comprising the aforementioned squeegee lip 120, defining the orifice 109, and also includes a short flange 146 which is coaxial with the flange 145 and is oriented toward the same side where the inner wall is flared, comprising the extension of the squeegee lip 120. The zone of the annular wall 147 of the element 124 between the two flanges 145 and 146 comprises a support bearing for the other end of the helical spring 129, which in the assembled position of the set extends axially within the reservoir 111.

The cap comprises a peripheral flange 148 connected to a base 149; the base 149 includes three radial fins 150, which are distributed at regular intervals on the periphery of the base and the function of which will be described hereinafter. Moreover, between its free edge and the lower edge of the radial fins 150, the inner wall of the flange 148 includes longitudinal fins 151, distributed at regular intervals.

The rod 107 is a hollow elongated element having a main cylindrical portion 152 intended to be accommodated inside the neck 103 and having an outside diameter that is smaller than the inside diameter of this neck 103. This main portion 152 is retracted at one end along a frustoconical wall 153, so that it ends in a tapered point 154 through which a narrow axial conduit passes comprising the elongation of the interior space of the main portion 152. This tapered point 154 is in turn penetrated by a plurality of transverse conduits 155 discharging into the aforementioned axial conduit. The tapered terminal portion 154 also comprises the support surface for the applicator 106, which is made from a porous foam having open cells.

In the assembled position, the applicator 106 is accommodated entirely inside the reservoir 111, with the transition zone between the wall 153 and the tapered point 154 being located in alignment with the squeegee lips 120. Moreover, the diameter of the applicator 106 in its largest portion is notably greater than the diameter of the circular orifice 109, such that the squeegee lips 120 can exert their squeegee action on the applicator 106 when the applicator is removed from the reservoir 111.

Remote from the point 154, the main portion 152 of the rod 107 flares along a frustoconical portion 156 to form the aforementioned tip 105. This tip 105 comprises the portion assuring the attachment of the rod 107 to the cap 104. To this end, the tip 105, comprising a cylindrical tubular element, has fins 157 on the outside, which are intended to be placed between the fins 151 of the cap 104, thus assuring a pressed fit of the rod !07 in the cap 104. However, in the assembled position, the fins 151 and 157 do not abut, thus forming longitudinal air outlet conduits along the flange 148 of the cap 104, which communicate with the central portion of the rod 107 via the passages left open between the fins 150. In the assembled position of the cap 104, the frustoconical wall 156 presses against the edge of the neck 103 in the opening 114, thus assuring the tightness of the applicator set 101.

The assembly of the applicator set according to the invention is effected as follows: The rod 107 carrying the applicator 106 is attached with its tip 105 in the cap 104 until the tip 105 abuts against the radial fins 150; the retention of these two elements is assured by the abutment of the edges of the longitudinal fins 151 and 157 against the lateral walls of the tip 105 and flange 148, respectively, of the cap 104. In this position, the frustoconical connection zone 156 and the end zone of the main portion 152 of the rod 107 near the connection zone 156 are contained within the cap 104.

The element comprising the neck 103, ending in the element 124, is introduced axially into the body of the bottle 136, by the end carrying the thread 139, until the element 124 abuts against the annular wall 137 of the bottle 102. The free end of the neck 103 is topped with the cap 104, and the fins 151 come to rest at their end against the neck 103, in such a way as to assure the closing engagement of the cap 104 with a sufficient locking action, with the neck 103 resting against the frustoconical wall zone 156 of the rod 107.

The partial set thus made is then retracted, and the spring 129 is then put in place, inside the reservoir 111 which then opens at the top; then the reservoir 111 is filled with the powder P, and the stopper 142 is screwed on. The set is now ready for use.

When the user wishes to apply the powder P to a surface, for example to the eyelids, the user may begin by pressing on the cap 104 in the direction of the arrows f2 shown in FIG. 2. In that case, the cap 104 functions like a pushbutton, causing the displacement of the element 124, which functions as the compacting piston, and the powder P is then compacted around the applicator 106, which undergoes the same axial translation, since it is attached to the cap 104. In this compacting operation, the air located in the reservoir 111 escapes through the pores of the foam comprising the applicator 106 and then through the transverse conduits 155 and the central conduit of the point 154, then via the axial conduit of the rod 107, to escape via the conduits formed along the cap 104. This escape of air toward the outside is symbolically represented by the arrows f in FIG. 2. The height of the neck 103 measured between the upper wall 137 of the bottle 102 and lower edge of the flange 148 of the cap 104, in the position of repose of the set (FIG. 1) is greater than or equal to the maximum distance that the piston 124 can travel. In this way, the air can always escape via the edge of the cap 104.

The displacement of the piston 124 causes an even compacting of the powder P about the applicator 106, with t he effect of filling this applicator 106 with powder. The user then releases the pressure on the cap 104, and the spring 129 pushes the piston 124 back, thus placing the powder P in suspension.

The applicator 106 is then ready for use. The user can remove the cap 104 with the applicator 106, suitably filled with powder for use.

It can also be noted that filling of the device can be done via the neck 103 after the stopper 142 is screwed on. Also, the device enables refilling of the reservoir 111 when it has been emptied of powder that it initially contained; it suffices to unscrew the stopper 142 to perform refilling again, or this can also be done via the neck 103

Figure 3:
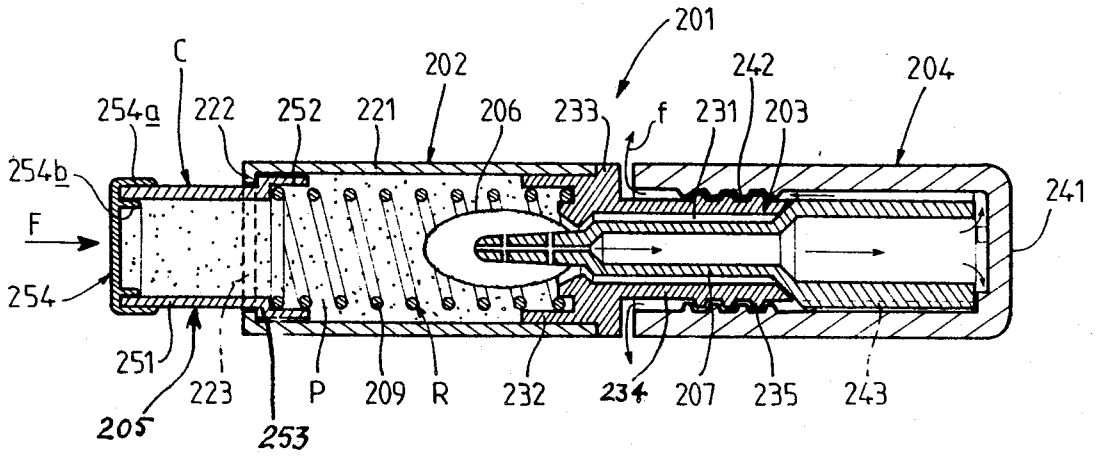
FIG. 3 is a longitudinal section through another applicator set according to the invention, with the cap in place on the container.

FIG. 3 shows a different applicator according to the invention, in which the compacting means is a piston mounted at the base of the container, and the cap is screwed onto the neck of the container. In FIG. 3, the applicator set is identified by reference numeral 201. It includes a container in the form of cylinder of revolution 202, closed by a part forming a neck 203, and also includes a cap 204 carrying an applicator 206 at the end of a rod 207. On the end of the container 202 opposite the neck 203, there is a piston 205 that cooperates with a helical spring 209. The cylindrical container 202 includes a cylindrical lateral wall 221, and on the end opposite the neck includes an annular collar 222 which is perpendicular to the lateral wall 221. The collar 222 forms a circular opening 223. The piston 205 is made up of two cylindrical parts: one, 25!, has a cross section the outside diameter of which is slightly less than the diameter of the opening 223, and the other part, 252, has cross section the outside diameter of which is greater than the former, but slightly smaller in cross section than the inside diameter of the cylindrical wall 221 of the container 202. The two cylindrical parts are joined via a perpendicular annular portion 253. The piston is closed with lid 254 which is affixed by telescoping, with the aid of two concentric flanges 254a and 254b on the outside end of the cylindrical part 251 of the piston 205. The cylindrical part 251 of the piston projects through the circular opening 223 made at the end of the container 202 and serves as a pushbutton to actuate the piston. The piston is attached such that it can reciprocate and rotate in the container 202. The cylindrical helical spring 209 is supported on one side on the annular portion 253 of the piston 205 and on the other on the part forming the neck 203; it extends axially in the container 202. The coils of the spring 209 are disposed in the vicinity of the lateral wall 221 of the container 202; taken as a whole, the spring has a diameter such that it can surround the applicator 206 when the set 201 is closed.

The part forming the neck 203 is provided on the inside with an axial cylindrical opening 231. At one of its ends, the outer wall includes a cylindrical annular portion 232 having a diameter slightly less than the inside diameter of the lateral walls 221 of the container 202; an outer collar 233 and a cylindrical portion 234 the outside diameter of which is smaller than the cylindrical portion 232; the cylindrical portion 234 is provided with an external thread 235 at one end. The cylindrical portion 232 is introduced with force into the container 202, with the collar 233 serving as a stop and assuring tightness. The spring 209 is surrounded by the cylindrical portion 232.

On its outside, the cap 204 has the shape of a cylinder of the same diameter as the container 202 and is provided with a base 241. The inside wall of the cap 204 on the side of the base 241 thereof is provided with radial fins 243, and the side of its open edge with an internal thread 242 corresponding to the external thread 235 of the part forming the neck. The radial fins 243 have a length such that they are located entirely beyond the part forming the neck 203 when the applicator set 201 is closed. The thread carried on the neck 203 includes fine axial grooves.

The applicator 206 and the rod 207 are the same shape as the applicator 106 and rod 107 shown in FIGS. 1 and 2.

The applicator set 201 shown in FIG. 3 functions as follows:

When the user wishes to apply the powder P to a surface, for example to the eyelids, the user begins by pressing on the part 251 forming a push element for the piston as indicated by the arrow F. The piston 205 is displaced axially in the container 202, compressing the helical spring 209 and compacting the powder about the applicator 206. In this operation, the air that is contained in the container 202 escapes through the pores of the foam comprising the applicator 206, then via the axial conduit of the rod 207 and then via the space made between the rod 207 and the cap 204 by the fins 243 and finally via the grooves of the thread of the neck 203 and the space included between the part forming the neck 203 and the cap 204. This escape of air is represented by the arrows f in FIG. 3. The compacting and the passage of the air have the effect of filling the applicator 206 with powder.

The user then relaxes the pressure on the part 251 of the piston acting as a pushbutton, and the spring pushes the piston 205 back until the annular portion 253 of the piston 205 abuts the collar 222 of the container 202.

The applicator 206 is then ready for use, and the user can unscrew the cap 204, remove the applicator 206, now suitably filled with powder, from the container 202 and proceed to apply the powder.

It should be noted also that refilling of the container 202 can be done simply by opening the lid 254 of the piston 205 and pouring the powder P in through the opening thus formed.

It will be understood that the embodiments described above and shown in the drawings are purely given as examples and may undergo any desired modification without departing from the scope of the invention.

What is claimed is:

1. An applicator set (101, 201) for a powdered or paste product, in particular a cosmetic product (P), including a container (102, 202) provided with a neck (103, 203) and intended to contain the product (P), a cap (104, 204) for closing the container (102, 202), and an applicator (106, 206) disposed at the end of a rod (107, 207) attached to the cap (104, 204), said container (102, 202) including means (C) for compacting the product (P) around the applicator (106, 206), means (C) on which the user can act to generate a compacting of the product, and elastic means (R) for returning said compacting means (C) to their position of repose when the user ceases acting upon it, characterized in that the applicator (106, 206) is made of a material permeable to air, and that the rod (107, 207) of the applicator (106, 206) includes at least one passage for evacuation of the air which is present in the container (102, 202) and which is compressed at the time of compacting, the air to be evacuated penetrating said rod (107, 207) after passing through the material permeable to the air of which the applicator (106, 206) is made, and escaping via said evacuation passage or passages to outside the cap (104, 204).

2. A set as defined by claim 1, characterized in that the material of the applicator is a porous and spongy material.

3. A set as defined by claim 1, characterized in that the rod (107, 207) comprises a hollow element, defining an axial conduit for passage of the air to be evacuated, said rod (107, 207) including a terminal portion that supports the applicator (106, 206), lateral air passage conduits being made in said terminal portion and discharging into said axial conduit.

4. A set as defined by claim 1, characterized in that the rod (107, 207) terminates at the opposite end of the applicator (106, 206) in a tip assuring the solid attachment of the rod (107, 207) and cap (104, 204), the air evacuation passage or passages communicating with the outside via at least one conduit made between the cap (104, 204) and the rod (107, 207).

5. A set as defined by claim 4, characterized in that the tip is introduced with force into the cap (104, 204), the lateral walls facing said tip and said cap (104, 204) including radial fins, between which the air evacuation conduits are made, the free end of the tip being spaced apart from the base of the cap (104, 204).

6. A set as defined by claim 5, characterized in that the fins carried by the cap (104, 204) assure the locking of the cap onto the end of the neck (103, 203) of the container (102, 202), in the closing position of the set.

7. A set as defined by claim 1 in which the compacting means (C) include a piston (124) mounted to slide in the container (102), this piston (124) being connected to an external pushbutton, characterized in that the neck (103) comprises a tubular element mounted to slide in an opening (138) made in the upper wall (137) of the container (102), and at its end adjacent to the container carrying an external collar comprising the piston (124) and returned to inside the aforementioned wall (137) of the bottle (102) by the action of the elastic return means (R), the means for controlling the piston (124) comprising the cap (104), in the position of closure of the container (102), the distance between the free edge of the cap (104) and said upper wall of the container (137) in the aforementioned position of closure being equal at least to the maximum travel of the piston (124).

8. A set as defined by claim 7, characterized in that the elastic return means (R) include a helical spring (129) disposed between the piston (124) and the base of the container (102) or an element carried by the base of the container (102).

9. A set as defined by claim 7, characterized in that the piston (124) also includes a squeegee holder, and to this end includes a lip (120) for squeegeeing the applicator (106).

10. A set as defined by claim 7, characterized in that the container (102) comprises a tubular body (136) bent at one of its ends to comprise the upper wall (137) of the bottle (102) traversed by the neck (103), the body (136) being closed at its other end with a removable stopper (142).

11. A set as defined by claim 1, characterized in that the compacting means (C) include a piston (205) mounted in the container (202), this piston being connected to an external pushbutton and to the elastic return means (R), the external pushbutton element (251)

projecting beyond the end of the container (202) that is opposite the neck (203).

12. A set as defined by claim 11, characterized in that the piston (205) is provided with a central hole making it possible to fill the applicator and with a stopper device (254) to close this central hole after filling of the applicator.

13. A set as defined by claim 11, characterized in that the elastic return means (R) comprise a helical spring (209) disposed between said piston (205), on the one hand, and an element (232), on the other, partially surrounding the applicator (206).

14. A set as defined by claim 13, characterized in that the element surrounding the applicator is attached to a part that forms a neck (203) having a thread (235), this part being mounted with force in the container (202).

15. A set as defined by claim 1 in which the product to be applied is a powder, characterized in that said powder (P) includes microcapsules containing liquid substances, these microcapsules releasing their contents in the vicinity of the applicator (106, 206) at the time of the compacting phase.

* * * * *